United States Patent [19]

Bouchard et al.

[11] 3,960,778

[45] June 1, 1976

[54] PYROCHLORE-BASED THERMISTORS

[75] Inventors: Robert Joseph Bouchard; Donald Burl Rogers, both of Wilmington, Del.

[73] Assignee: E. I. Du Pont de Nemours and Company, Wilmington, Del.

[22] Filed: Feb. 15, 1974

[21] Appl. No.: 442,904

[52] U.S. Cl. ..... 252/519; 252/518; 252/320

[51] Int. Cl.[2] ..... H01B 1/06; H01C 1/06

[58] Field of Search ..... 252/518, 519, 520

[56] References Cited

UNITED STATES PATENTS

| | | | |
|---|---|---|---|
| 3,560,410 | 2/1971 | Schubert | 252/518 |
| 3,583,931 | 6/1971 | Bouchard | 252/520 |
| 3,630,969 | 12/1971 | Popowich | 252/520 |
| 3,681,262 | 8/1972 | Bouchard | 252/520 |
| 3,775,347 | 11/1973 | Bouchard | 252/518 |
| 3,847,829 | 11/1974 | Bouchard | 252/63.5 |

OTHER PUBLICATIONS

W. R. Cook and H. Jaffe, Phys. Rev. 88, p. 1426 (1952).

*Primary Examiner*—Leland A. Sebastian
*Assistant Examiner*—Josephine Lloyd

[57] ABSTRACT

Powder compositions comprising finely divided solid solutions of certain pyrochlore-related oxides and glass powder, and thermistors thereof, useful in the electronics art.

32 Claims, No Drawings

PYROCHLORE-BASED THERMISTORS

BACKGROUND OF THE INVENTION

This invention relates to electronics, and more particularly to thermistors, and powder compositions for making thermistors.

Thermistors are semiconductors exhibiting large variations of resistance with temperature, that is, a large temperature coefficient of resistance (TCR). When the resistance varies negatively with temperature, the thermistor is said to have a negative TCR; when the resistance varies positively with temperature, the thermistor is said to have a positive TCR. There exists a need for negative TCR thermistors and compositions for producing the same. The applications for NTC (negative temperature coefficient) thermistors are principally in temperature sensing, environmental sensing, current control and power.

There is a need in the electronics industry for both discrete (bulk) and thick-film thermistors. By "thick film" is meant films obtained by printing dispersions of powders (usually in an inert vehicle) on a substrate using techniques such as screen and stencil printing, as opposed to the so-called "thin" films deposited by evaporation or sputtering. Thick-film technology is discussed generally in *Handbook of Materials and Processes for Electronics*, C. A. Harper, Editor, McGraw-Hill, New York, 1970, Chapter 11.

By discrete or bulk thermistors is meant thermistors which are not deposited on a substrate, as in thick-film technology, but rather thermistors made by mixing together various powders, pressing them to the desired shape, and firing or sintering to make the body physically and electrically continuous. Usually, such sintering is not accompanied by melting of all the particles.

Pyrochlore is a mineral of varying composition generally expressed as $(Na,Ca)_2(Nb,Ti)_2(O,F)_7$, but which approaches the simpler formulation $NaCaNb_2O_6F$. The structure of the mineral, established by characteristic X-ray reflections, has a cubic unit cell with dimensions of about 10.4 Angstroms and contains eight formula units of approximate composition $A_2B_2X_{6-7}$. The term pyrochlore is used interchangeably herein with the term pyrochlore-related oxide to mean oxides of the pyrochlore structure with the approximate formula $A_2B_2O_{6-7}$. Certain compounds of the pyrochlore-related (cubic) crystal structure are known to be useful as resistors. See, for example, Schubert U.S. Pat. No. 3,560,410, issued Feb. 2, 1971; Hoffman U.S. Pat. No. 3,553,109, issued Jan. 5, 1971; Bouchard U.S. Pat. No. 3,583,931, issued June 8, 1971; Popowich U.S. Pat. No. 3,630,969, issued Dec. 28, 1971; Bouchard U.S. Pat. No. 3,681,262, issued Aug. 1, 1972; and Bouchard U.S. Pat. No. 3,775,347, issued Nov. 27, 1973; each of which is incorporated by reference herein.

Pyrochlores which are highly conductive or metallic-like are known; see, e.g., Bouchard U.S. Pat. No. 3,583,931. Pyrochlores which are semiconducting, i.e., of low conductivity or insulating, are known; $Cd_2Nb_2O_7$ is disclosed by W. R. Cook and H. Jaffe, Phys. Rev. 88, 1426 (1952). Semiconducting or insulating pyrochlores are also disclosed in commonly assigned copending application Bouchard U.S. Ser. No. 387,479, filed Aug. 10, 1973, now U.S. Pat. No. 3,847,829. Solid solutions between pyrochlores having the same B site cation (in $A_2B_2O_7$), $Bi_2Ru_2O_7$ and $Nd_2Ru_2O_7$, have been disclosed by Bouchard and Gillson in Mat. Res. Bull. 6, 669 (1971).

There is a need for both discrete and thick-film resistors which have NTC characteristics, which can be fired in air and yet withstand temperatures such as 750°–950°C. In thick-film technology, since temperatures in this range are typical firing temperature for other thick-film components (e.g., conductors, switches, etc.), there is a special need for NTC thermistor compositions fireable there. In discrete thermistor technology, thermistors fireable at lower temperatures such as 850°C. require less power.

SUMMARY OF THE INVENTION

This invention is powder compositions useful for making thermistors; the compositions comprise (a) 50–98%, preferably 60–85%, of a crystalline powder which is a solid solution of pyrochlore-related oxides, one such oxide being highly conductive and another such oxide being semiconductive, and (b) 2–50%, preferably 15–40%, of a glass powder as a binder. Preferred compositions are those wherein (a) comprises 10–50 mole percent of the highly conductive pyrochlore-related oxide and 50–90 mole percent of the semiconductive oxide, based on the total moles of pyrochlore-related oxide present.

More preferred compositions are those wherein said highly conductive pyrochlore-related oxide is $Bi_2Ru_2O_7$. Also more preferred are those compositions wherein the semiconductive pyrochlore-related oxide is $Bi_2BB'O_7$ wherein B is Cr, Fe, In, or Ga and B' is Nb, Ta, or Sb, or $Cd_2Nb_2O_7$.

Compositions which are preferred include those wherein the highly conductive pyrochlore-related oxide comprises 15–45 mole percent of (a), and the semiconductive oxide comprises 55–85% thereof.

Also a part of this invention are such compositions dispersed in an inert liquid vehicle, as well as thermistors of such compositions.

DETAILED DESCRIPTION

The compositions of the present invention comprise solid solutions of a metallic-like or highly conductive pyrochlore-related oxide (pyrochlore) and a semiconductive or insulating pyrochlore. The preferred conductive pyrochlore is $Bi_2Ru_2O_7$; the preferred semiconductive pyrochlores are $Cd_2Nb_2O_7$, and $Bi_2BB'O_7$, wherein B is Cr, Fe, In or Ga and B' is Nb, Sb, or Ta. To find solid solutions between, e.g., $Bi_2Ru_2O_7$ and $Cd_2Nb_2O_7$ or $Bi_2CrNbO_7$, where the respective B site cations are so dissimilar, is surprising.

The pyrochlore solid solutions can be formed from the respective binary oxides (e.g., $Bi_2O_3$, $RuO_2$, CdO, etc.) or from the preformed pyrochlores themselves. In either event, the solid solutions are formed by heating finely divided reactants in an oxygen or air atmosphere to temperatures usually between 600° and 1250°C., dependent upon the particular solid solution to be formed. Heating may be accomplished in a covered or sealed platinum vessel, for example.

The glass powder in the compositions of the present invention serves to bind the particles of solid solution pyrochlore together, and in the case of thick-film thermistors, to bind the fired thermistor to the substrate. The composition of the glass is not important, any of the commonly used glass binders being useful.

Various metal oxides may be used in formulating the glass, including those of the alkalis, alkaline earths, transition metals, lead, bismuth, cadmium, copper, zinc, etc. The glasses may be borates, silicates, borosilicates, aluminoborates, aluminosilicates, aluminoborosilicates, any with the addition of other common glass formers such as phosphates, germinates, antimonates, arsenates, etc. Among such glasses are those of Larsen and Short U.S. Pat. No. 2,822,279, issued Feb. 2, 1958; Dumesnil U.S. Pat. No. 2,942,992, issued May 3, 1957; etc.

Various conventional additives may be added to minimize drift of the resistivity values at room temperature during use. Pt and Au, therefore, may be used in effective quantities, if desired up to about 10% of the total weight of pyrochlore solid solution plus glass.

The powder compositions of the present invention are finely divided. The particles are generally sufficiently finely divided to pass through a 200-mesh screen, preferably a 400-mesh screen (U.S. Standard Sieve Scale).

When discrete thermistors are to be made, conventional pressing and firing techniques are used (see, e.g., U.S. Pat. No. 3,652,463, issued Mar. 28, 1972).

When thick-film thermistors are involved, the compositions used in the present invention comprise finely divided inorganic powders dispersed in an inert liquid vehicle. The powders are sufficiently finely divided to be used in conventional screen or stencil printing operations, and to facilitate sintering. The compositions are prepared from the solids and vehicles by mechanical mixing and printed as a film on ceramic dielectric substrates in the conventional manner. Any inert liquid may be used as the vehicle. Water or any one of various organic liquids, with or without thickening and/or stabilizing agents and/or other common additives, may be used as the vehicle. Exemplary of the organic liquids which can be used are the aliphatic alcohols; esters of such alcohols, for example, the acetates and propionates; terpenes such as pine oil, terpineol and the like; solutions of resins such as the polymethacrylates of lower alcohols, or solutions of ethylcellulose, in solvents such as pine oil and the monobutyl ether of ethylene glycol monoacetate. The vehicle may contain or be composed of volatile liquids to promote fast setting after application to the substrate.

The ratio of inert liquid vehicle to solids in the dispersions may vary considerably and depends upon the manner in which the dispersion is to be applied and the kind of vehicle used. Generally, from 0.2 to 20 parts by weight of solids per part by weight of vehicle will be used to produce a dispersion of the desired consistency. Preferred dispersions contain 30–75% vehicle.

The relative proportions of the components of the powder compositions are not of themselves critical, the materails and their relative proportions being selected by one skilled in the art dependent upon what resistivity and TCR are desired, the degree of adhesion required where thick-film thermistors are involved, the sintering temperature which can be tolerated, etc. Thus, within the solid solution pyrochlore phase, the highly conductive or metallic-like pyrochlore is generally 10–50%, preferably 15–45%, on a molar basis, of the pyrochlore solid solution.

The pyrochlore solid solution is generally 50–98%, preferably 60–85%, of the total weight of pyrochlore solid solution plus glass binder.

Firing or sintering of the powder compositions of the present invention normally occurs at temperatures in the range 750°–950°C., for 5 minutes to 2 hours, depending on the particular compositions employed and the desired degree of sintering, as will be known to those skilled in the art. Generally, shorter firing times may be employed at higher temperatures.

EXAMPLES

The following examples are given to illustrate the invention. Examples 1–12 illustrate the formation of solid solutions of highly conductive and semiconductive pyrochlores, while Examples 13–23 show the use of the solid solutions of Examples 1–12, respectively, in formulating the compositions of the present invention and making thick-film thermistors therewith. Example 24 discloses a discrete (not thick film) thermistor.

In the examples and elsewhere in the specification and claims all parts, percentages and ratios are by weight, unless otherwise stated; however, relative amounts of conductive and semiconductive pyrochlores in the solid solutions are on a molar basis.

Resistivities were calculated from resistance measurements as follows. A thick film thermistor was connected to a Triplett type 1 digital volt ohmmeter, Model 8035. Resistance readings were taken at 25°C. Resistivities were calculated in ohm-cm. using the equation:

$$R = \frac{\text{rho} \cdot l}{A}$$

where

R = resistance in ohms
rho = resistivity in ohm-cm.
l = length of resistor
A = cross-sectional area of resistor Temperature coefficient of resistance (TCR) is expressed as a fractional change in resistance/°C. and commonly is referred to as $\alpha$. $\alpha$ was determined from the following relationship:

$$\alpha = 1/R \ \frac{dR}{dT} = \frac{\beta}{T2}$$

where $\beta$ = slope of the linear plot ln R vs. 1/T°K
T = T°K

X-ray data was obtained using a Norelco diffractometer using CuK$\alpha$ radiation.

EXAMPLES 1–12

Solid solutions were prepared between $Bi_2Ru_2O_7$, a highly conductive pyrochlore, and various semiconductive pyrochlores, $Cd_2Nb_2O_7$, $Bi_2CrNbO_7$, $Bi_2CrTaO_7$ and $Bi_2CrSbO_7$. These solid solutions were prepared from the oxides in these examples; Table I sets forth the oxides and the relative amounts used. The oxides were ground together for 30 minutes in an automatic mortar grinder with an agate mortar and pestle, pressed into a pellet in a small hand press, placed in a covered Pt crucible and fired to the temperatures listed for 16 hours. The black products were single phase pyrochlores with the approximate lattice parameters listed. Occasionally an extra regrinding and firing step was required when the X-ray pattern indicated the presence of small amounts of another phase.

TABLE I

Preparation of Pyrochlore Solid Solutions

| Example No. | Formula | Wt. of Oxide (g.) CdO | $Bi_2O_3$ | $Nb_2O_5$ | $RuO_2$ | Firing Temp. (°C.) | Unit Cell Dimensions $A_0$ (A) |
|---|---|---|---|---|---|---|---|
| 1 | $Cd_{1.1}Bi_{0.9}Nb_{1.1}Ru_{0.9}O_7$ | 2.2896 | 3.3991 | 2.3699 | 1.9414 | 1225 | 10.36 |
| 2 | $Cd_{1.2}Bi_{0.8}Nb_{1.2}Ru_{0.8}O_7$ | 1.2704 | 1.5367 | 1.3150 | 0.8778 | 1225 | 10.37 |
| 3 | $Cd_{1.3}Bi_{0.7}Nb_{1.3}Ru_{0.7}O_7$ | 1.4005 | 1.3683 | 1.4496 | 0.7815 | 1225 | 10.38 |
| 4 | $Cd_{1.6}Bi_{0.4}Nb_{1.6}Ru_{0.4}O_7$ | 2.1836 | 0.9905 | 2.2603 | 0.5658 | 1225 | 10.38 |
| | | $Bi_2O_3$ | $RuO_2$ | $Cr_2O_3$ | $Nb_2O_5$ | | |
| 5 | $Bi_2Ru_{0.6}Cr_{0.7}Nb_{0.7}O_7$ | 5.3865 | 0.9230 | 0.6150 | 1.0754 | 1100 | 10.41 |
| 6 | $Bi_2Ru_{0.5}Cr_{0.75}Nb_{0.75}O_7$ | 6.7610 | 0.9654 | 0.8270 | 1.4463 | 1100 | 10.42 |
| 7 | $Bi_2Ru_{0.4}Cr_{0.8}Nb_{0.8}O_7$ | 5.4317 | 0.6205 | 0.7088 | 1.2395 | 1100 | 10.42 |
| | | $Bi_2O_3$ | $RuO_2$ | $Cr_2O_3$ | $Ta_2O_5$ | | |
| 8 | $Bi_2Ru_{0.5}Cr_{0.75}Ta_{0.75}O_7$ | 3.0851 | 0.4406 | 0.3773 | 1.0972 | 1100 | 10.43 |
| 9 | $Bi_2Ru_{0.4}Cr_{0.8}Ta_{0.8}O_7$ | 3.0786 | 0.3517 | 0.4017 | 1.1679 | 1100 | 10.42 |
| 10 | $Bi_2Ru_{0.3}Cr_{0.85}Ta_{0.85}O_7$ | 3.0725 | 0.2632 | 0.4259 | 1.2383 | 1100 | 10.42 |
| | | $Bi_2O_3$ | $RuO_2$ | $CrSbO_4$ | — | | |
| 11 | $Bi_2Ru_{0.4}Cr_{0.8}Sb_{0.8}O_7$ | 3.2841 | 0.3752 | 1.3405 | — | 1000 | 10.38 |
| | | $Bi_2O_3$ | $RuO_2$ | CdO | $Nb_2O_5$ | | |
| 12 | $Cd_{1.25}Bi_{0.75}Nb_{1.25}Ru_{0.75}O_7$ | 1.5207 | 0.8143 | 1.3095 | 1.3555 | 1225 | 10.38 |

In some preparations a few percent excess $Bi_2O_3$ was present to increase crystallinity of the pyrochlore.

EXAMPLES 13–23

The finely ground powders (minus 400 mesh) prepared in Examples 1–11 were mixed in an 80/20 pyrochlore/glass ratio; the glasses used had the formulation listed in Table II. Enough vehicle (about 9 parts terpineol per part ethylcellulose) was added to give the proper consistency for screen printing (generally about 3 parts solids per part vehicle). A 0.200 inch (0.500 cm.) square pattern was printed on a dense alumina substrate (Alsimag 614) bearing prefired Pd/Ag (1/3 by weight) terminations, and fired in a belt furnace according to a standard firing cycle used in the thick-film technology, with a peak temperature of 850°C.; the entire firing cycle, from room temperature to 850°C. and back, lasted about 60 minutes, with about 8 minutes at peak. All samples appeared well sintered and were about 1-mil thick; X-ray measurements taken on several of the fired samples showed no decomposition of the solid solutions of pyrochlores.

The resistivity at 27°C. (R) and temperature coefficient of resistance (TCR) are reported in Table II. The data in Table II show that the compositions of the present invention can produce thermistors with a range of R and NTCR. The negative TCR's set forth there show the usefulness of the compositions of the present invention.

EXAMPLE 24

When the solid solution pyrochlores of Examples 1–4 are mixed with the glass of Example 11, pressed into a pellet and sintered at 750°–950°C., discrete NTC thermistors are obtained.

EXAMPLE 25

Thermistors were prepared using the pyrochlore of Example 12; the procedure was that of Example 13, except that the ratio of pyrochlore to glass was 60/40, by weight; furthermore, gold as a drift additive was present, about 6% of the total weight of pyrochlore plus glass. The amounts of solids used were 1.8 g. pyrochlore of Example 12, 1.2 g. glass B of Table II, and 0.2 g. gold powder. R was $2.6 \times 10^4$ ohms/square and NTCR was 10,400 p.p.m./°C. (both at 27°C.).

We claim:

1. Powder compositions useful for making thermistors, said compositions comprising a. 50–98% of a crystalline powder which is a solid solution of pyrochlore-related oxides, one such oxide being highly conductive and another such oxide being semiconductive, and b. 2–50% of a glass powder as a binder.

2. Compositions according to claim 1 dispersed in an inert liquid vehicle.

3. Compositions according to claim 1 comprising 60–85% (a) and 15–40% (b).

TABLE II

Thermistor Preparations

| Example No. | Pyrochlore | Glass* | Resistivity, 27°C. (ohms/square) | NTCR, 27°C. (ppm/°C) |
|---|---|---|---|---|
| 13 | $Cd_{1.1}Bi_{0.9}Nb_{1.1}Ru_{0.9}O_7$ | A | $1.1 \times 10^3$ | 7,800 |
| 14 | $Cd_{1.2}Bi_{0.8}Nb_{1.2}Ru_{0.8}O_7$ | A | $3.8 \times 10^3$ | 9,000 |
| 15 | $Cd_{1.3}Bi_{0.7}Nb_{1.3}Ru_{0.7}O_7$ | A | $7.4 \times 10^3$ | 11,200 |
| 16 | $Cd_{1.6}Bi_{0.4}Nb_{1.6}Ru_{0.4}O_7$ | A | $1.2 \times 10^6$ | 22,000 |
| 17 | $Bi_2Ru_{0.6}Cr_{0.7}Nb_{0.7}O_7$ | B | $7.8 \times 10^4$ | 10,700 |
| 18 | $Bi_2Ru_{0.5}Cr_{0.75}Nb_{0.75}O_7$ | B | $6.1 \times 10^5$ | 16,300 |
| 19 | $Bi_2Ru_{0.4}Cr_{0.8}Nb_{0.8}O_7$ | B | $2.1 \times 10^6$ | 19,900 |
| 20 | $Bi_2Ru_{0.5}Cr_{0.75}Ta_{0.75}O_7$ | B | $4.2 \times 10^5$ | 15,000 |
| 21 | $Bi_2Ru_{0.4}Cr_{0.8}Ta_{0.8}O_7$ | B | $1 \times 10^6$ | 16,100 |
| 22 | $Bi_2Ru_{0.3}Cr_{0.85}Ta_{0.85}O_7$ | B | $1 \times 10^8$ | 30,400 |
| 23 | $Bi_2Ru_{0.4}Cr_{0.8}Sb_{0.8}O_7$ | B | $1 \times 10^6$ | 16,100 |

*Glass A is 61.6% PbO, 10.0% $B_2O_3$, 25.9% $SiO_2$, $Al_2O_3$
Glass B is 65% PbO, 34% $SiO_2$, 1% $Al_2O_3$.

4. Compositions according to claim 1 wherein (a) comprises 10–50 mole percent of the highly conductive pyrochlore-related oxide and 50–90 mole percent of the semiconductive pyrochlore-related oxide, based on the total moles of pyrochlore-related oxide present.

5. Compositions according to claim 1 wherein the highly conductive pyrochlore-related oxide is $Bi_2Ru_2O_7$.

6. Compositions according to claim 4 wherein the highly conductive pyrochlore-related oxide is $Bi_2Ru_2O_7$.

7. Compositions according to claim 1 wherein the semiconductive pyrochlore-related oxide is $Bi_2BB'O_7$ wherein B is Cr, Fe, In, or Ga and B′ is Nb, Ta, or Sb.

8. Compositions according to claim 4 wherein the semiconductive pyrochlore-related oxide is $Bi_2BB'O_7$ wherein B is Cr, Fe, In, or Ga and B′ is Nb, Ta, or Sb.

9. Compositions according to claim 5 wherein the semiconductive pyrochlore-related oxide is $Bi_2BB'O_7$ wherein B is Cr, Fe, In, or Ga and B′ is Nb, Ta, or Sb.

10. Compositions according to claim 1 wherein the semiconductive pyrochlore-related oxide is $Cd_2Nb_2O_7$.

11. Compositions according to claim 4 wherein the semiconductive pyrochlore-related oxide is $Cd_2Nb_2O_7$.

12. Compositions according to claim 5 wherein the semiconductive pyrochlore-related oxide is $Cd_2Nb_2O_7$.

13. Compositions according to claim 4 wherein (a) comprises 15–45 mole percent of the highly conductive pyrochlore-related oxide and 55–85 mole percent of the semiconductive pyrochlore-related oxide.

14. Compositions according to claim 5 wherein $Bi_2Ru_2O_7$ is 15–45 mole percent of (a).

15. Compositions according to claim 9 wherein $Bi_2Ru_2O_7$ is 15–45 mole percent of (a).

16. Compositions according to claim 12 wherein $Bi_2Ru_2O_7$ is 15–45 mole percent of (a).

17. Compositions according to claim 5 dispersed in an inert liquid vehicle.

18. Compositions according to claim 6 dispersed in an inert liquid vehicle.

19. Compositions according to claim 7 dispersed in an inert liquid vehicle.

20. Compositions according to claim 8 dispersed in an inert liquid vehicle.

21. Compositions according to claim 9 dispersed in an inert liquid vehicle.

22. Compositions according to claim 10 dispersed in an inert liquid vehicle.

23. Compositions according to claim 11 dispersed in an inert liquid vehicle.

24. Compositions according to claim 12 dispersed in an inert liquid vehicle.

25. Thermistors of the composition of claim 1.

26. Thermistors of the composition of claim 4.

27. Thermistors of the composition of claim 5.

28. Thermistors of the composition of claim 6.

29. Thermistors of the composition of claim 7.

30. Thermistors of the composition of claim 9.

31. Thermistors of the composition of claim 10.

32. Thermistors of the composition of claim 12.

* * * * *